US009938733B2

(12) United States Patent
Black

(10) Patent No.: US 9,938,733 B2
(45) Date of Patent: Apr. 10, 2018

(54) WIRE ROPE TENSION GRID IMPROVEMENTS

(71) Applicant: INTERAMERICA STAGE, INC., Sanford, FL (US)

(72) Inventor: Mark Thomas Black, Port Orange, FL (US)

(73) Assignee: InterAmerica Stage, Inc., Sanford, FL (US)

( * ) Notice: Subject to any disclaimer, the term of this patent is extended or adjusted under 35 U.S.C. 154(b) by 0 days.

(21) Appl. No.: 14/167,957

(22) Filed: Jan. 29, 2014

(65) Prior Publication Data

US 2014/0144725 A1 May 29, 2014

Related U.S. Application Data

(63) Continuation of application No. 11/704,087, filed on Feb. 8, 2007, now Pat. No. 8,672,092.

(51) Int. Cl.
*E04G 5/00* (2006.01)
*A63J 3/00* (2006.01)
*A63J 7/00* (2006.01)

(52) U.S. Cl.
CPC ..... *E04G 5/00* (2013.01); *A63J 3/00* (2013.01); *A63J 7/00* (2013.01)

(58) Field of Classification Search
CPC ..... B60R 3/007; E01D 19/106
USPC ..... 182/150, 137, 138; 52/81.3
See application file for complete search history.

(56) References Cited

U.S. PATENT DOCUMENTS 265,551 A * 10/1882 Wickersham ..... E06C 1/34 182/222
448,101 A 3/1891 Whittier
867,178 A * 9/1907 Wiley ..... B60R 3/007 182/116
896,213 A * 8/1908 Kerfoot ..... E04G 21/3261 182/138
1,602,096 A * 10/1926 Barnes ..... E06B 9/52 160/106
1,788,296 A * 1/1931 Herndon ..... E06B 9/52 160/379
2,076,810 A 4/1937 Deckard
2,283,574 A * 5/1942 Pillsbury ..... E04B 1/6108 160/380
2,326,052 A * 8/1943 Moore ..... E21B 19/14 182/113
2,709,626 A * 5/1955 Woodburn ..... E06C 7/16 182/121

(Continued)

FOREIGN PATENT DOCUMENTS

EP 549359 6/1993
WO WO9501495 1/1995

*Primary Examiner* — Katherine W Mitchell
*Assistant Examiner* — Candace L Bradford

(57) ABSTRACT

A wire rope tension grid is a walking surface comprised of interwoven wire rope. The wire rope is supported by a framework of steel angle and tubing. The framework is supported by mounts that are hung from the support beams in the ceiling of a structure, often a performing art center, a television studio, a black box theater, museum dioramas, theme park scenes, live animal pens, or other entertainment venues. These grids are not intended for public usage, but rather are intended for operation staff. New improvements to these grids are listed in this document.

19 Claims, 7 Drawing Sheets

(56) References Cited

U.S. PATENT DOCUMENTS 3,021,114 A * 2/1962 O'Connell ..... E04H 17/06 256/24
3,352,418 A * 11/1967 Swallow ..... B07B 1/48 134/56 R
3,434,567 A * 3/1969 Wilkins ..... E04G 1/151 182/222
3,776,382 A * 12/1973 Wright ..... B07B 1/48 101/127.1
4,068,855 A * 1/1978 Hackett ..... A47F 5/13 211/189
4,129,197 A * 12/1978 Preston ..... E04G 21/3223 182/112
4,388,982 A * 6/1983 Yonahara ..... E04G 3/20 182/115
4,401,186 A * 8/1983 Dobersch ..... E04G 5/14 182/113
4,433,700 A * 2/1984 Dohet ..... E04H 15/322 135/124
4,449,843 A 5/1984 Wendel
4,492,364 A * 1/1985 Boyanton ..... E04H 17/10 256/32
4,662,038 A * 5/1987 Walker ..... F16B 5/0692 160/392
4,981,225 A 1/1991 Cole
5,165,207 A 11/1992 Oehlke
5,203,428 A * 4/1993 Beeche ..... E04B 1/19 182/113
5,310,482 A * 5/1994 Sather ..... B07B 1/46 162/100
5,402,988 A * 4/1995 Eisele ..... E01F 13/022 160/351
5,543,196 A * 8/1996 Robinson ..... A01K 1/007 160/330
5,573,125 A 11/1996 Denny
5,649,690 A * 7/1997 Kilmer ..... E04H 12/2223 248/156
5,711,400 A * 1/1998 Tan ..... E04G 1/152 182/119
5,787,955 A * 8/1998 Dargie ..... E02D 29/12 160/368.1
5,797,641 A * 8/1998 Lincoln ..... B60P 3/40 296/26.04
5,799,752 A 9/1998 Perry
5,984,121 A 11/1999 Cole
6,006,923 A * 12/1999 Helmy ..... B07B 1/4645 209/397
6,026,545 A * 2/2000 Duggan ..... E04H 9/02 24/129 B
6,125,910 A * 10/2000 Pepperell ..... E06B 9/01 160/371
6,164,476 A * 12/2000 Rene ..... B65D 19/12 220/4.28
6,182,790 B1 2/2001 Denny et al.
6,186,274 B1 * 2/2001 Reynolds ..... A62B 1/22 182/112
6,318,255 B1 * 11/2001 Larson ..... B41F 15/36 101/127.1
6,505,669 B2 * 1/2003 Lilie ..... E06L 39/04 160/371
6,536,167 B2 3/2003 Glavan
6,561,107 B1 * 5/2003 Wood ..... A47B 3/0812 108/132
6,722,512 B2 * 4/2004 Scully ..... A47F 5/13 211/175
6,776,260 B2 * 8/2004 Cjepa ..... E04G 21/3204 182/137
6,837,388 B2 1/2005 Calleja
6,851,661 B1 * 2/2005 Penning ..... E04H 17/18 256/19
7,014,053 B2 3/2006 Calleja
7,191,907 B2 * 3/2007 Conway ..... A47B 47/027 182/138
7,389,856 B2 * 6/2008 Irvin ..... E04G 1/152 182/119
7,735,606 B1 * 6/2010 Norton ..... E04G 5/147 182/186.6
7,740,048 B2 * 6/2010 Wilson ..... E06B 9/52 160/179
7,954,656 B1 * 6/2011 Cuzzocrea ..... A47F 5/103 211/189
8,123,001 B1 * 2/2012 Apostolopoulos .... E01D 19/106 182/150
8,347,939 B2 * 1/2013 Brabeck ..... E06B 9/52 160/371
2002/0020584 A1 * 2/2002 Cjepa ..... A62B 1/22 182/138
2002/0029932 A1 3/2002 Apostolopoulos
2002/0104710 A1 8/2002 Thompson et al.
2002/0144469 A1 10/2002 Glavan
2003/0001424 A1 * 1/2003 Mundell ..... A47C 7/16 297/452.56
2003/0131539 A1 7/2003 Burford et al.
2003/0145799 A1 * 8/2003 Hays ..... A01K 1/034 119/502
2003/0177705 A1 * 9/2003 Forbis, Sr. ..... E04D 13/00 52/3
2004/0079586 A1 4/2004 Walls et al.
2004/0117928 A1 * 6/2004 Apostolopoulos .... E01D 19/106 14/77.1
2004/0245512 A1 * 12/2004 Naegele ..... E04H 17/066 256/47
2006/0201744 A1 9/2006 Curtis et al.
2008/0110583 A1 * 5/2008 Lallemand ..... E04B 9/0428 160/371
2008/0251322 A1 * 10/2008 Irvin ..... 182/222
2010/0018802 A1 * 1/2010 Sani ..... E04G 3/30 182/142
2011/0204760 A1 * 8/2011 Finstad, III ..... A47B 57/06 312/311

* cited by examiner

WIRE ROPE TENSION GRID IMPROVEMENTS

This application is a continuation application of and claims priority to U.S. patent application Ser. No. 11/704,087, filed on Feb. 8, 2007, which is hereby incorporated by reference in its entirety.

BACKGROUND

These inventions improve the design of the current grid structure. The use, safety, and assembly of safe aerial platforms is likewise improved. The present invention is used to allow personnel safe access to high reach areas for mechanical tasks and maintenance operations, such as changing the position of theatrical lights, servicing air conditioning ducts, etc.

The wire rope tension grid has been in use for decades. It is usually installed in performing art centers, black box theaters, and in locations were it is difficult, impossible, or impractical to get a ladder or man lift in an area for maintenance. Through both the use and construction of many wire rope tension grid systems, InterAmerica Stage, Inc. has made various improvements to the structures. Currently we will be releasing a new line of improved wire rope tension grids. These grids will feature both the improvements that have been made over time by our firm and new improvements that have been developed and tested by our engineering staff.

Safety is one of the major reasons the wire rope tension grid is used. It minimizes the risk of falling while performing high reach operations using ladders or lifts. The other major benefit to the wire rope tension grid is that light can pass through without casting shadows on surfaces below it. This is particularly useful in the entertainment industry, where lighting of props, the focus of sound, and special effects placement are of the utmost importance in a performance.

A BRIEF SUMMARY OF THE INVENTION

Modularity: A wire rope tension grid is installed as a modular item, able to be removed for service and transported easily for erection. The connections to the modular attachments have been improved. Through-bolts connect hanger points to the grid. This provides a hard connection as opposed to a floating clamped connection. This is a further improvement over the pieces in the past that are non-modular, being welded to their respective support hangers.

Reducing the lateral stress on the wire rope within the wire rope tension grid was a major priority. Rolled edges and chamfered through holes have aided in this regard. Even the position of the hole itself has been reconsidered, and positioned accordingly. The cable is supported over the frame support tube increasing the area of impact and lessening the stress at any particular point in the cable. This allows for a horizontal load to be applied to the wire rope.

Structural strength of the frame has likewise been improved by adding support tabs that do not interfere with the location of the wire rope. These help distribute the vertical and torsion loads that are exerted on the frame while it is in use.

The bottom portion of the hanger connections were further improved, providing streamlined outer perimeter and corner connections for safe handling and aesthetics.

The top of the hanger mounting plates are sized to allow for a flush walking surface.

A lighting pipe outrigger system has been developed applying lighting fixtures or light bars outboard from principal wire rope tension grid suspension points.

Originally, a spacer on the wire rope was used to assist in the swaging of a copper stop sleeve on the wire. With the use of a new purpose built hydraulic swaging tool this is no longer necessary.

Through bolts within the frame allow for a rigid connection to adjacent wire tension grid panels. This helps to prevent the frame from bowing under stresses applied by taut wire rope.

In an instance where a wire rope tension grid system is required to have the wire rope non-perpendicular and non-parallel to the frame, a new way of distributing the wires had to be realized. A wire rope turn pin was added to the frame so that the wire rope can be weaved in the same way that the regular rectangular tension grids. The wire rope turn pin decreases the stress on the cable. Elliptical slots on frame for the cables further lessen pinch points.

A BRIEF DESCRIPTION OF THE DRAWINGS

A DETAILED DESCRIPTION OF THE PREFERRED EMBODIMENTS

Figure 3:
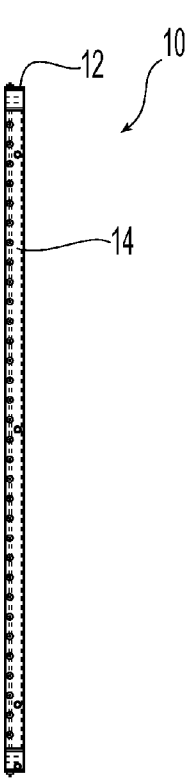
FIG. 3 is a side view of the wire rope tension grid of FIG. 1.
Figure 1:
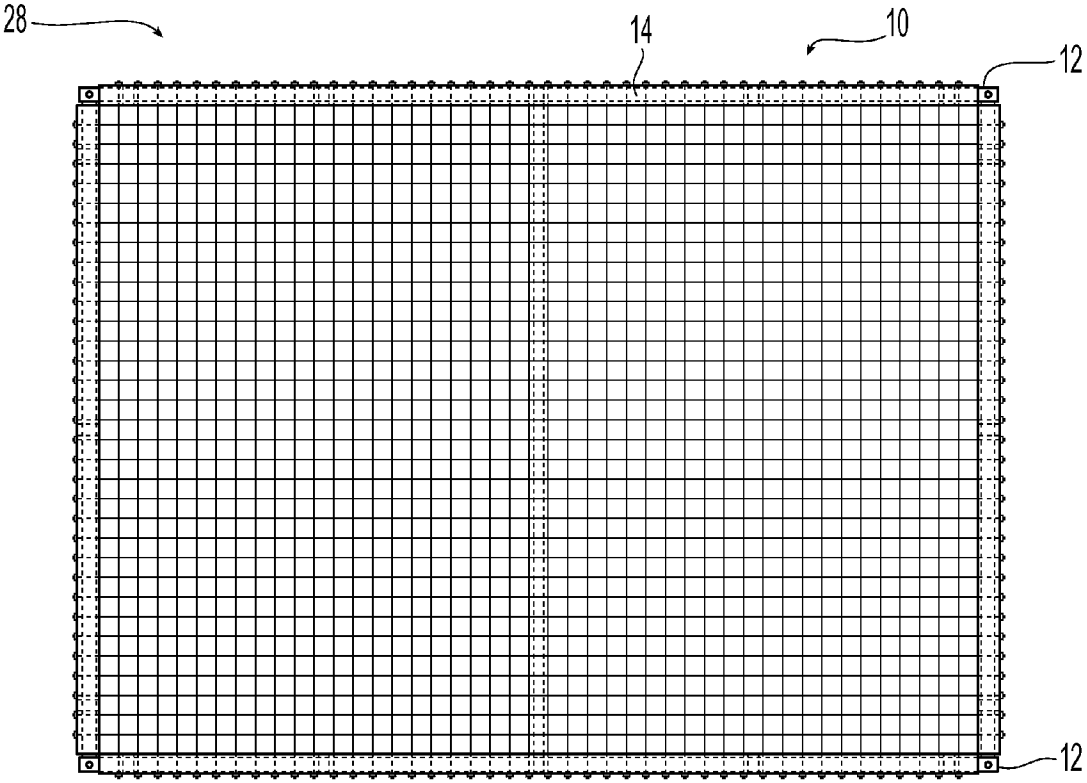
FIG. 1 is a top view of one embodiment of a wire rope tension grid according to the present invention.
Figure 2:
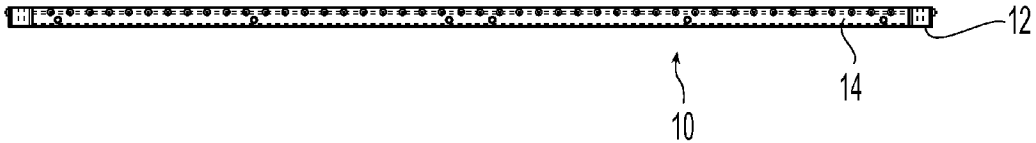
FIG. 2 is a front view of the wire rope tension grid of FIG. 1.

FIGS. 1-3 display a complete wire rope tension grid panel 10. These wire rope tension grid panels 10 are constructed of mild steel tubing 12 and mild steel angle 14. The dimensions of the said steel vary per application, but are most often constructed of 3/16" thick 1.5" times 1.5" mild steel tubing 12 with a piece of mild steel angle 14 measuring 1.5" times 1.75"

Holes 16 are predrilled into the mild steel angle 14 at increments of 2" center. See FIG. 2. These holes 16 are 5/32" in diameter. Holes 18,20 are also predrilled into specific points on the mild steel tubing 12 for modular through-holes 18 and for hanger plate bolts (20). See FIGS. 4 and 5. The through-holes 18 are used by bolts 22 with nuts 24 and spacers 26 to join and maintain the spacing of two adjacent wire rope tension grid panels 10.

Figure 4:
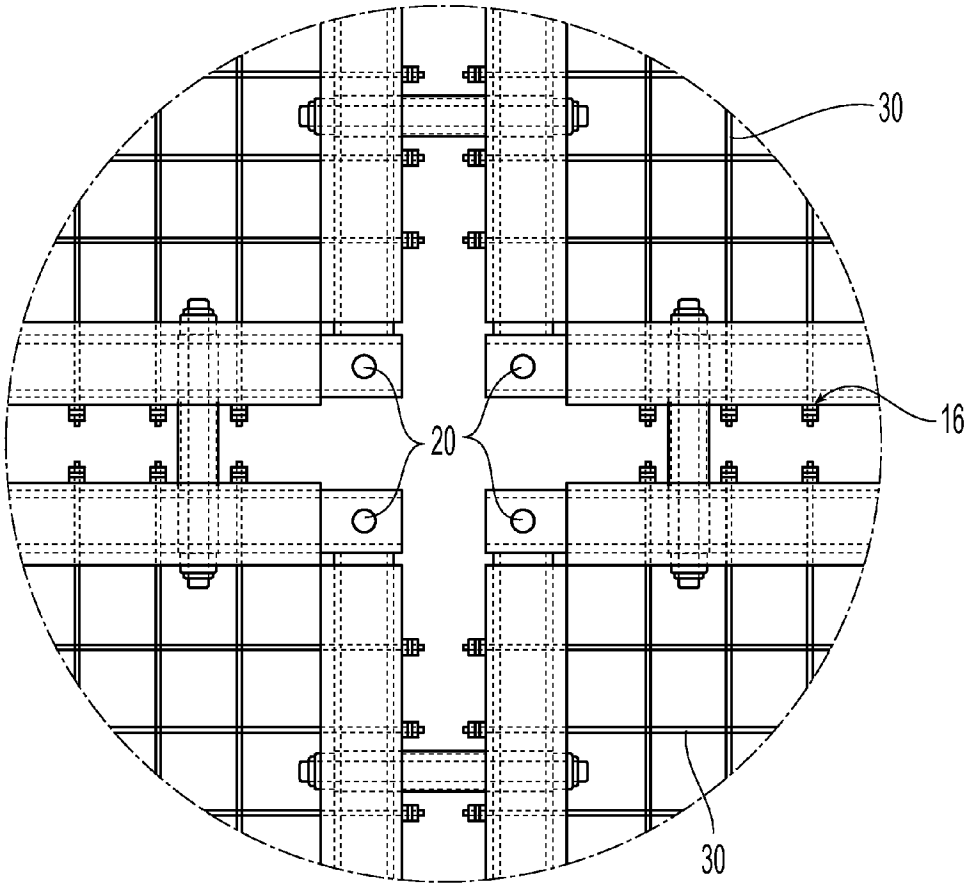
FIG. 4 is a top view of the wire rope tension grid; displays thru holes for mounting brackets, a lack of spacers at the termination points of the wire rope, and new support bar locations.
Figure 5:
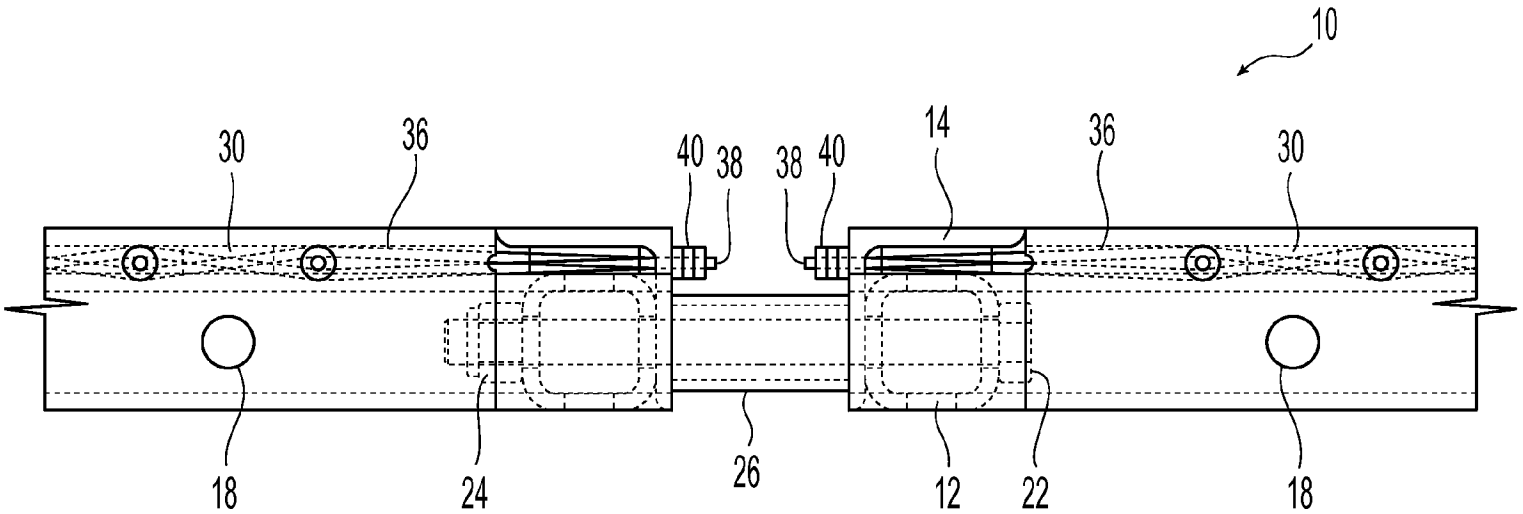
FIG. 5 is a side view of the wire rope tension grid; displays lowered cable thru holes for cable support, and thru bolt holes for mounting adjacent panels.
Figure 6:
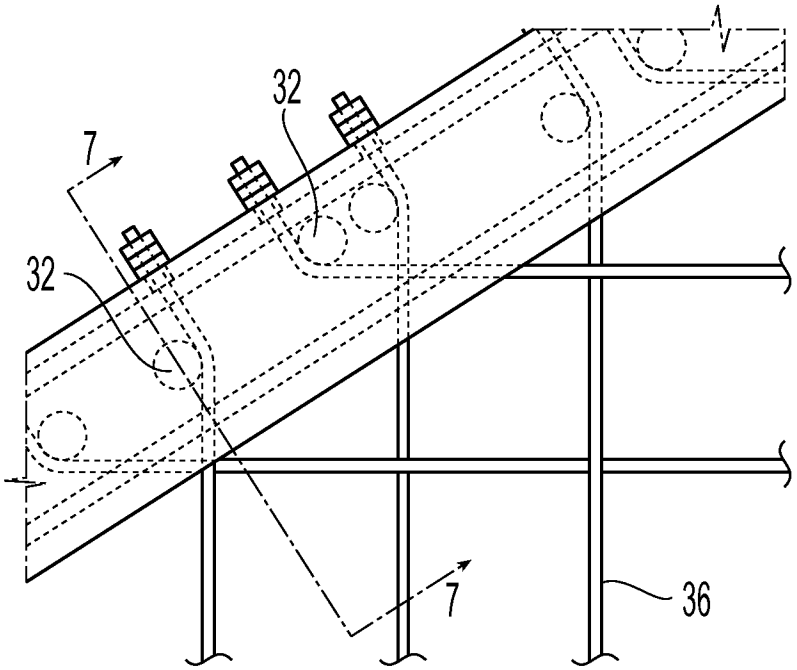
FIG. 6 is a top view of wire rope tension grid where wire rope is not perpendicular and parallel to the frame, displays wire rope turn pin.
Figure 7:
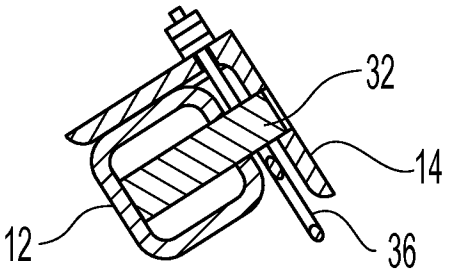
FIG. 7 is a cross section of the frame with a wire rope turn pin.

The mild steel angle 14 is welded onto the mild steel tubing 12 making the basic frame structure 28. This basic frame structure 28 is reinforced by supports 30 welded above the locations of the through-holes 18 used for modular attachments. FIGS. 4 and 5 display these supports 30 as hidden lines.

FIGS. 4-6 and 7 display the use of the wire rope turn pin 32. If the design calls for the use of this device then a hole will be drilled into the mild steel angle 14 and mild steel tubing 12. The wire rope turn pin will then be inserted into the frame and will be plug welded from the top side of the-milled steel angle.

Basic frame structure 28 is often powder coated or painted, often flat black, so that is not visually intrusive to the general public.

The wire rope 36 is then weaved into the frame by hand. The ends 38 of the wire rope 36 are inserted into the 5/32" holes. A copper stop sleeve 40 is slid over the ends of the cable. A modified torque wrench is used to apply an accurate amount of tension within the wire rope 36 as the copper stop sleeve 40 is swaged onto the wire rope 36. This is done on both sides of the wire rope 36 resulting in an evenly distributed amount of tension along the entire wire rope tension grid panel 10.

Figure 11:
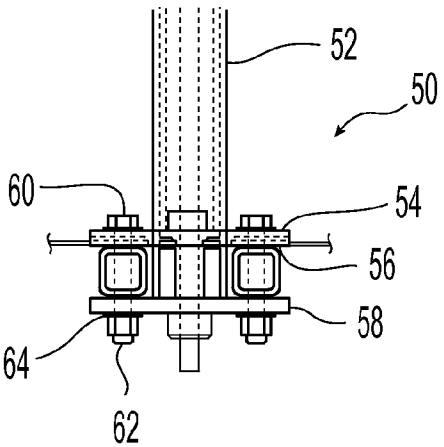
FIGS. 10 and 11 illustrate a hanger assembly for connecting frames within grid system.
Figure 10:
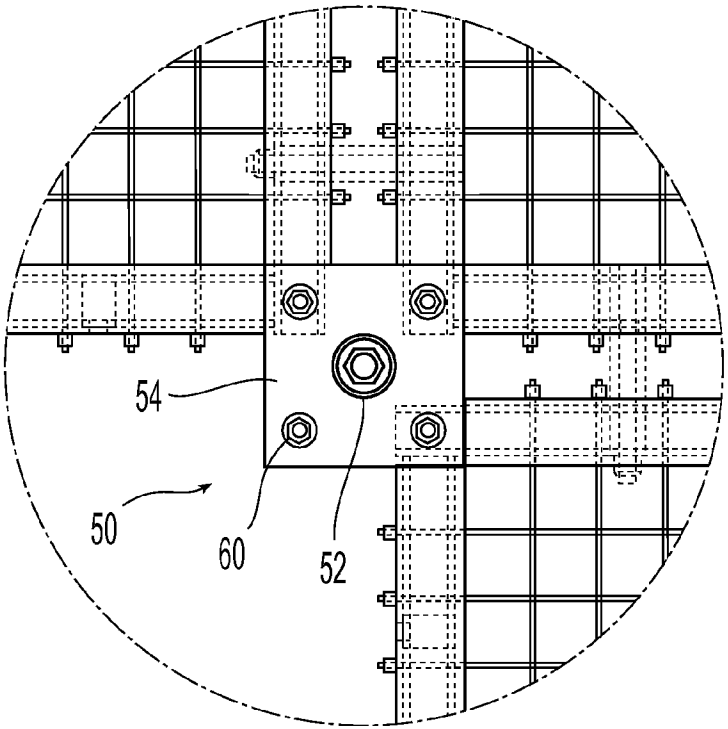

The hanger assembly 50 is comprised of mild steel tubing 52, often 1.5" schedule 40. The upper hanger plate 54 is welded onto the mild steel tubing 52. Holes 56 are drilled in locations that correspond to the predrilled holes 20 in the frame's mild steel tubing 12. The upper portion of the entire hanger assembly 50 varies per application and structure. Please see FIGS. 10 and 11.

The lower portion 58 of the hanger plate assembly 50 is a steel plate that is drilled to correspond to the bolt holes 20 for the frame and the upper hanger plate 54 of the hanger assembly 50. These parts are often painted or powder coated, often flat black, so that is not visually intrusive to the general public and so that it matches the frame.

Figure 13:
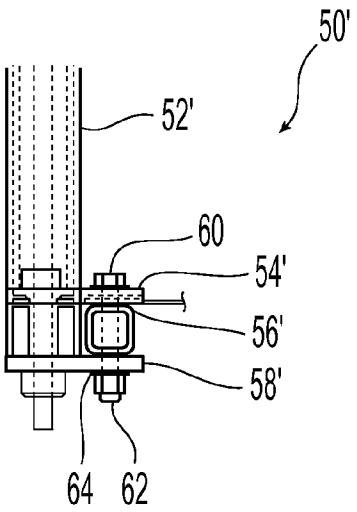
FIGS. 12 and 13 illustrate a hanger assembly for connecting frames at the edge of the grid system.
Figure 12:
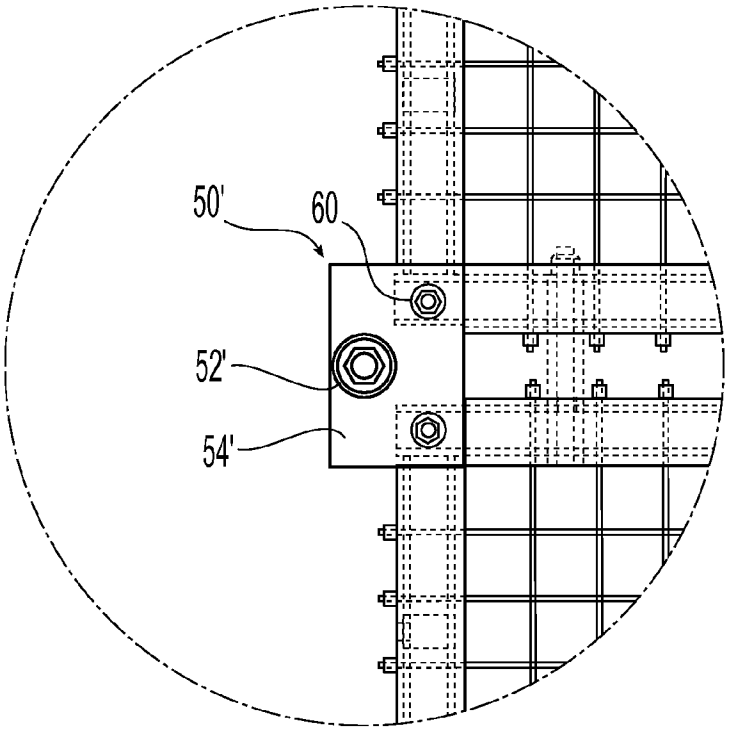

A side version of a hanger assembly 50' is illustrated in FIGS. 12 and 13. The hanger assembly 50' has mild steel tubing 52' and . The upper hanger plate 54' is welded onto the mild steel tubing 52'. Holes 56' are drilled in locations that correspond to the predrilled holes 20 in the frame's mild steel tubing 12. A lower portion 58' of the hanger plate assembly 50' is a steel plate that is drilled to correspond to the bolt holes 20 for the frame and the upper hanger plate 54' of the hanger assembly 50'.

The entire assembly is erected on site and is bolted together using grade 5, ½" times 13" Carbon Zinc Plated Hex Head Bolt 60, with a ½ Carbon Zinc Plated Nylok nut 62, and flat ½ washers 64.

Figure 9:
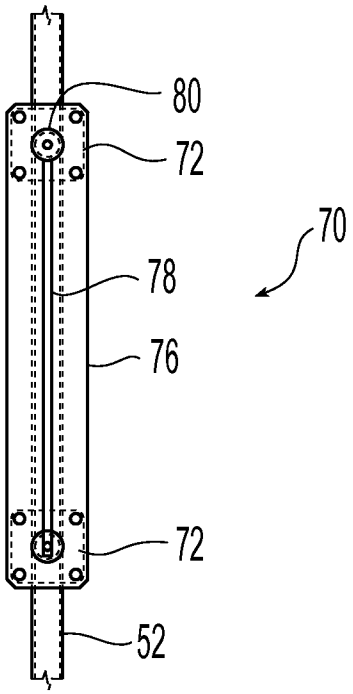
FIG. 9 is a front view of the lighting pipe system of FIG. 8.
Figure 8:
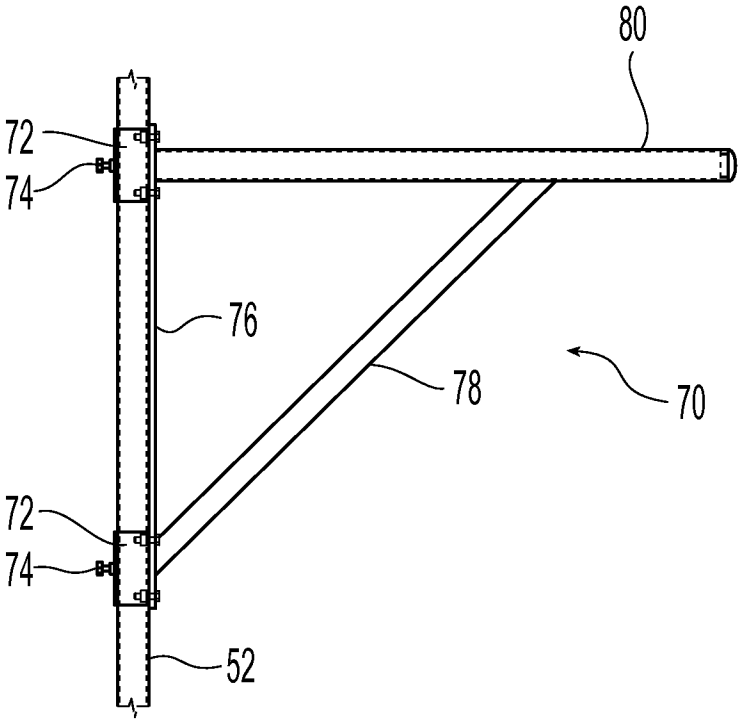
FIG. 8 is a side view of a lighting pipe system. Displays the bracket that connects it to the hanger pipe.

FIGS. 8 and 9 display the outrigger lighting pipe system 70, it is comprised of at least two pipe clamps 72 with screws 74 used to adjust the location of the system, a flat piece of mild steel 76 measuring the width of the pipe clamps 72, a support beam 78 of mild steel, and an outrigger pipe 80 for hanging electrical equipment such as lights and speakers.

The pipe clamps 72 are measured out to fit the support hangers. Likewise, the outrigger pipe 80 is sized to fit common lighting fixtures with ease.

All of the parts of the wire rope tension grid system are design for modular installation, easy and safe use, and simple maintenance.

The invention claimed is:

1. A modular wire rope tension platform comprising:

a plurality of tubular members, the plurality of tubular members having opposed ends, the plurality of tubular members forming a generally rectangular configuration;

a plurality of angled members, one of the plurality of angled members being fixedly attached to a respective one of the plurality of tubular members, each of the plurality of angled members extending along at least a portion of a length of a respective one of the plurality of tubular members and creating an elongated space therebetween a respective one of the plurality of tubular members and one of the plurality of angled members;

a plurality of pins disposed in each of the plurality of tubular members, each of the plurality of pins extending beyond a top surface of a respective one of the plurality of the tubular members and into the elongated space; and a plurality of wire rope segments, each of the plurality of wire rope segments extending between at least two of the plurality of angled members, each of the plurality of wire rope segments engaging at least one of the plurality of pins and passing in the elongated space and attached to at least one of the plurality of angled members.

2. The modular wire rope tension platform according to claim 1, wherein the plurality of tubular members have a plurality of through holes, the plurality of through holes configured to accept an attachment member to secure another modular wire rope tension platform thereto.

3. The modular wire rope tension platform according to claim 1, wherein the opposed ends of each of the plurality of tubular members have openings therein for attachment to a hanger.

4. The modular wire rope tension platform according to claim 1, wherein the plurality of wire rope segments are interwoven.

5. The modular wire rope tension platform according to claim 1, wherein the plurality of wire rope segments are sized to allow for light to pass through the modular wire rope tension platform.

6. The modular wire rope tension platform according to claim 1, wherein the plurality of tubular members form a square.

7. The modular wire rope tension platform according to claim 1, wherein each of the plurality of wire segments passes through an opening in a respective one of the plurality of angled members.

8. The modular wire rope tension platform according to claim 1, wherein each of the plurality of tubular members has a lengthwise internal opening and each of the plurality of pins disposed therein extends across the lengthwise internal opening of the respective tubular member and across the elongated space and terminates within the attached angled member.

9. A modular wire rope tension platform comprising:

a plurality of tubular members, each of the plurality of tubular members having opposed ends, the plurality of tubular members forming a generally rectangular configuration with a central opening;

a plurality of angled members, each of the plurality of angled members being fixedly attached to only one of the plurality of tubular members on a side thereof opposite the central opening, each of the plurality of angled members extending along at least a portion of a length of the attached tubular member and forming an elongated space therebetween; and a plurality of wire rope segments, each of the plurality of wire rope segments extending between opposing ones of the plurality of angled members, each of the plurality of wire rope segments passing in the elongated space between a respective one of the plurality of the tubular members and the attached angled member and through an opening in the attached angled member, wherein there is a space between each of the plurality of wire rope segments and at least one of the tubular member and the attached angled member.

10. The modular wire rope tension platform according to claim 9, wherein each of the plurality of wire rope segments are secured against an outside surface of a respective one of the plurality of angled members.

11. The modular wire rope tension platform according to claim 9, wherein each of the plurality of tubular members have a plurality of through holes, the plurality of through holes configured to accept an attachment member to secure another modular wire rope tension platform thereto.

12. The modular wire rope tension platform according to claim 9, wherein the opposed ends of the plurality of tubular members have openings therein for attachment to a hanger.

13. The modular wire rope tension platform according to claim 9, wherein the plurality of wire rope segments are interwoven.

14. The modular wire rope tension platform according to claim 9, wherein the plurality of wire rope segments are sized to allow for light to pass through the modular wire rope tension platform.

15. The modular wire rope tension platform according to claim 9, wherein the plurality of tubular members form a square.

16. A frame support for a modular wire rope tension platform comprising:

a tubular member having opposed ends and an internal opening extending therebetween;

an angled member fixedly attached to the tubular member, the angled member extending along at least a portion of a length of an outside surface of the tubular member, the angled member extending over a top surface of the tubular member and forming an elongated space between the tubular member and an inside surface of the angled member; and a plurality of wire rope segments, each of the plurality of wire rope segments extending from an outside surface of the angled member and passing through the elongated space between the top surface of the tubular member and the inside surface of the angled member.

17. The frame support according to claim 16, further comprising:

a plurality of pins disposed in the tubular member, each of the plurality of pins extending from the internal opening of the tubular member and beyond the top surface of the tubular member and into the elongated space between the tubular member and angled member.

18. The frame support according to claim 16, further comprising:

a plurality of pins disposed in the tubular member, each of the plurality of pins extending from the internal opening through the top surface of the tubular member and the elongated space between the tubular member and angled member and into the angled member.

19. The frame support according to claim 16, further comprising:

a plurality of openings in the frame support, each of the plurality of openings extending through the tubular member, the internal opening in the tubular member, and the angled member fixedly attached to the tubular member, the plurality of openings being parallel to the top surface of the tubular member.

* * * * *